United States Patent [19]

Bous

[11] 4,100,724

[45] Jul. 18, 1978

[54] APPARATUS FOR DYEING FILAMENTARY MATERIAL

[76] Inventor: Karl Bous, Sternstr. 74, 5600 Wuppertal 2, Germany

[21] Appl. No.: 744,394

[22] Filed: Nov. 23, 1976

[30] Foreign Application Priority Data

Dec. 2, 1975 [DE] Fed. Rep. of Germany ..... 2554132

[51] Int. Cl.[2] ..... D06B 1/02; D01H 13/30

[52] U.S. Cl. ..... 57/35; 68/205 R; 239/574

[58] Field of Search ..... 68/205 R; 118/DIG. 21, 118/314, 323, 325; 222/447, 450; 239/574; 57/35, 164, 165, 77.3

[56] References Cited

U.S. PATENT DOCUMENTS

| | | | |
|---|---|---|---|
| 2,080,193 | 5/1937 | Bakker | 57/35 |
| 2,182,752 | 12/1939 | Janes | 68/205 R |
| 2,218,811 | 10/1940 | Chaussabel | 68/205 R |
| 2,867,354 | 1/1959 | Tanzola et al. | 222/450 X |
| 3,206,922 | 9/1965 | Nagahara et al. | 57/77.3 |
| 3,458,983 | 8/1969 | Hamel | 57/35 |
| 3,650,674 | 3/1972 | Newton | 68/205 R X |
| 3,899,903 | 8/1975 | Lapierre | 68/205 R |
| 3,921,377 | 11/1975 | Snyder | 68/205 R X |
| 3,937,045 | 2/1976 | Klein et al. | 68/205 R |
| 4,005,590 | 2/1977 | McLean | 68/205 R X |

FOREIGN PATENT DOCUMENTS

| | | | |
|---|---|---|---|
| 1,203,145 | 7/1959 | France | 222/447 |
| 1,296,725 | 11/1972 | United Kingdom | 68/205 R |

*Primary Examiner*—Philip R. Coe

*Attorney, Agent, or Firm*—Neuman, Williams, Anderson & Olson

[57] ABSTRACT

Filamentary material to be dyed is moved under tension at high speed past a dye-spraying nozzle adapted to spray such material intermittently. The dye application may be varied by applying the dye as the filamentary material moves past a series of nozzles controlled to spray dye in different phase relationships. The dye application to the filamentary material may also be processed by applying a twist to the sprayed filamentary material by applying a gaseous blast tangentially thereto. The dye may be applied in spaced chambers having baffles which engage the dye jets whereby dye is reflected into the moving filamentary material.

12 Claims, 8 Drawing Figures

Fig.1
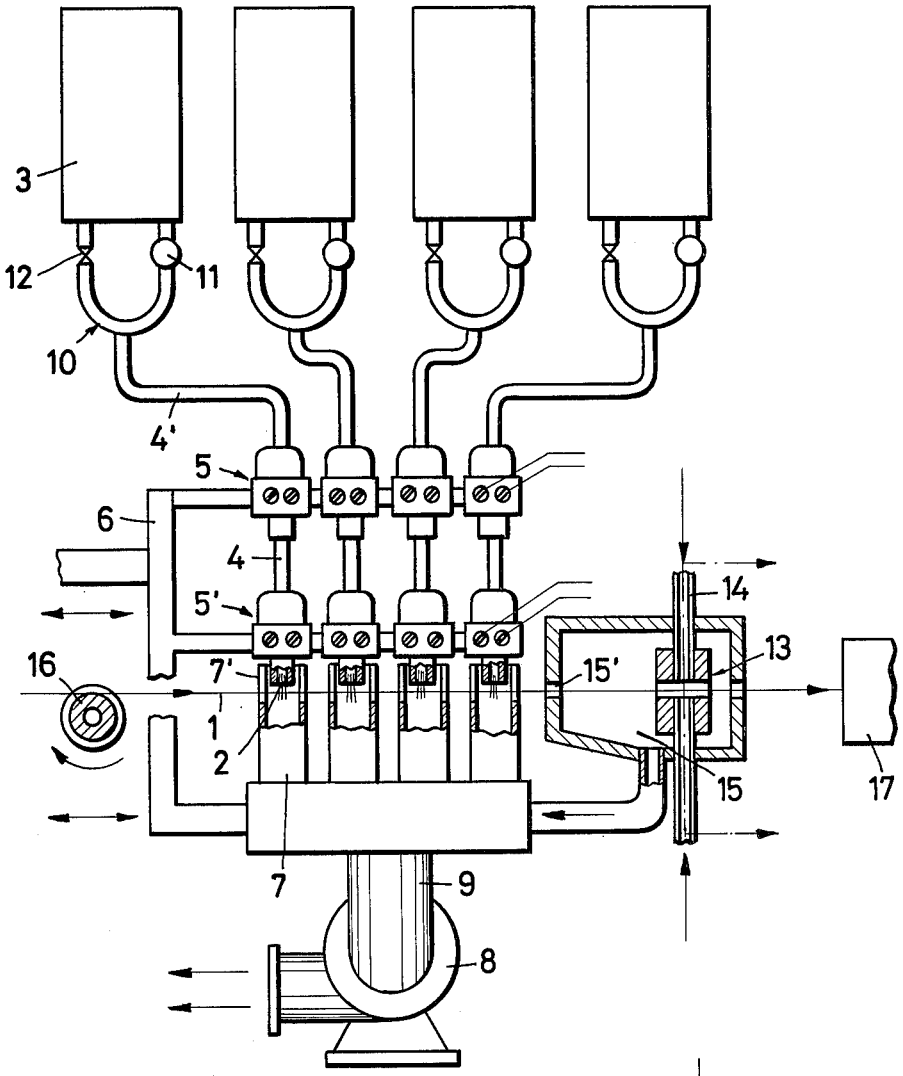
Fig.2
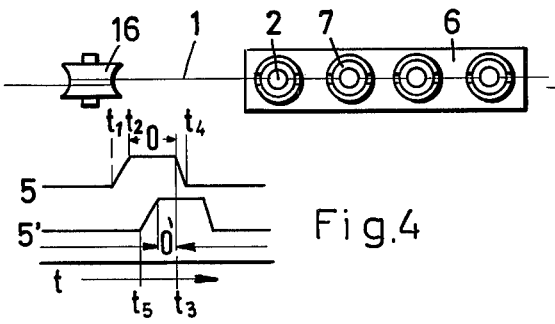
Fig.4
Fig.3
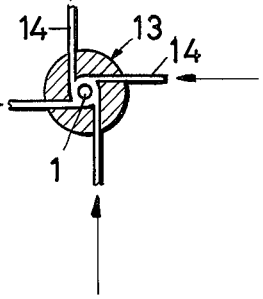

APPARATUS FOR DYEING FILAMENTARY MATERIAL

The present invention relates to a device for differently dyeing different portions of filamentary material, such as textile threads, yarns and the like, in which the material is moved continuously past at least one spraying nozzle under tension and is thus sprayed with liquid dyestuff.

It is known that hand and machine knitting yarns, carpet yarns or threads, yarns for decorative materials and the like can be dyed over different portions by dyes in different quantity and sequence. These yarns or threads with so-called 'Space' — or 'Multicolour' — dyeing have already been manufactured for a long period but at a rather great expense. For this purpose for example skeins of yarn are untied at one or more positions in such a way that the dye, during skein dyeing, does not reach the untied positions. It is furthermore known that multi-coloured dyeing of yarn skeins can be carried out by only partial immersion of the skeins in different liquids dye. It is moreover no longer novel to print yarn skeins at different places with several colours and then to fix the skeins in a steamer. This technique has recently been improved in that the skeins are sprayed with colour dyes on a slowly travelling belt and are then guided in one operation through a fixing chamber where the dyestuff is fixed on the yarn. In all these procedures the necessary reeling and recoiling of the yarn skeins requires operations that make great demands on time and machinery.

There is therefore already a change to dyeing yarns in portions, not in the form of skeins, but in other forms. Thus an attempt has been made for example to dye yarn in crossed spools by injecting different liquid dyes by the insertion of appropriate needles into the coils. This process which is known by the name 'astro-dyeing' has however only been able to gain ground to a limited extent for certain applications owing to the uncontrolled colouring of the yarns.

In a further well known process for the multi-colour dyeing for example of carpet yarns, the yarn is knitted to form a hose or tube, after which the latter is printed with the desired colours and is then fixed in a fixing installation. After fixing, however, the dyestuff thickener is washed out and the knitted tubes must be passed to rinsing machines on which the tubes are treated and the yarn is wound on suitable spools for further processing. It is a further drawback that the knitted loops moulded during fixing have an unfavourable effect on the yarn.

According to another known process, the so-called 'Martins' process, a group of threads consisting of about 400 threads is printed, fixed, washed and dried in one operation. This process which is in itself extremely rational nevertheless has the drawbacks that it is only possible to operate at slow rates of travel of the thread amounting to about 20 to 60 meters per minute, and that the installation in question is very costly and is only suitable for carpet yarns. Moreover, the winding up of the various yarns or threads, after the aforementioned treatment, causes difficulties that are not inconsiderable.

It is furthermore known that a liquid dye can be squirted onto a quickly rotating disc during the dyeing of yarns, from which it is sprayed in the form of small drops through the action of centrifugal force, on yarns arranged round the disc and travelling past it. In this way, reproducible yarn dyes cannot be obtained.

Finally, it is also no longer new to move yarns for differential dyeing in batches in the stretched state past several dye spray nozzles, the latter completing a changing movement, in order in this way to obtain portions of yarn with different tints. As the changing movement takes place at only limited speed, in this manner, even at relatively slow rates of yarn travel, only relatively long portions of yarn can be dyed differently and this only with comparatively limited throughput.

The invention is concerned with variously dyeing thread or yarn or other filamentary material, in batches so that high throughput performance and nevertheless relatively short differently dyed portions of the material can be obtained.

The invention is related to the method already mentioned in that the material is moved past a dye spraying nozzle but according to the invention the material travels at a high speed, corresponding to normal rewinding speeds of up to 600 meters per minute and more and at the same time is acted on intermittently with brief, reproducible colour spray pulses amounting only to a few milliseconds in duration. It has been found preferable for the material to be rotated continuously about its longitudinal axis during this intermittent dyeing action. Furthermore, the material can be acted on by reflected jets of ejected colour or dye oscillated transversely to the direction of travel.

For carrying out the dyeing process of the invention and in particular for producing the necessary reproducible dye ejection pulses of only a few milliseconds duration, use is made of a device provided with a device for unwinding and winding the filamentary material, a delivery or feed mechanism and at least one dye spraying or ejection nozzle located adjacent the run of the material and connected by a pipe provided with a valve, preferably an electromagnetically operated injection valve, to a liquid dye supply container, the injection valve being designed as a double valve with two individual valves connected one after the other and arranged to perform opening and closing cycles with phase shift between them. By means of electromagnetic control pulses control is achieved of the series-connected individual valves forming the double valve such that by relative phase delay of their opening times, dye ejection pulses of such short duration can be produced that even with high rates of travel of the material of up to 600 meters per minute and more, extremely short portions of it, of for instance only to 10 mm in length, can be obtained as is desired for the so-called 'minispace' dyeing. By analogous means, with correspondingly shorter phase difference between the opening times of the individual valves of the double, a 'shortspace' dyeing with differently dyed portions of material 10 to 40 mm long can be produced.

According to a further feature of the invention, several of the dye spraying nozzles, each with its double valve control, are positioned one behind the other in the direction of travel of the material, and thus a separate liquid dye pipe runs to each nozzle. As these individual dye spraying nozzles can be opened in different phase relationships with one another by means of appropriate control pulses, there are produced in this way possibilities of dyeing the material in extremely varied ways, and in spite of the reproducibility of the individual dye injection nozzles, correspondingly fault free irregular dyeing effects can be obtained.

According to a further feature of the invention, a blower device serving to apply a twist can be located downstream of the dye injection nozzles, the device surrounding the material passing through it so that nozzles of the device for the blowing medium are aligned transversely to the direction of travel of the material and tangentially thereto; upstream of the dye injection nozzles is arranged a twist limiter having the form for example of a guide roller around which the travelling material is looped. Owing to the twist imparted to the material during the dye spraying operation, a generally uniform circumferential distribution of the dyes can be obtained even though the dye nozzles are arranged on one side of the path of the material.

According to a further feature of the invention, the effect of the brief dye injection action on the travelling filamentary material is reached in that the injection chamber containing the dye injection jets emerging from the nozzles is provided with baffle plates that can be movably driven to reflect the jets onto the material as it moves by. The plates are preferably pivotably movable about an axis parallel to the material and are driven through appropriate movement transmitting levers from a common camshaft. In this arrangement, a spool with reverse drawn-off can be provided for producing a twist in the material upstream of the spraying nozzles.

The invention will be more readily understood from the following illustrative description and the accompanying drawings in which:

FIG. 1 is a view partly in section of a device for dyeing filamentary material in accordance with the invention, the device having four dye spraying double valves arranged one behind another in the direction of travel of the material, FIG. 2 substantially shows the material passing by the dye spraying nozzles;

FIG. 3 is a sectional view through a blower device taken on the line III—III in FIG. 1;

FIG. 4 is a diagram showing opening and closing times to illustrate the mode of operation of the double valves;

Figures 6, 7, 8:
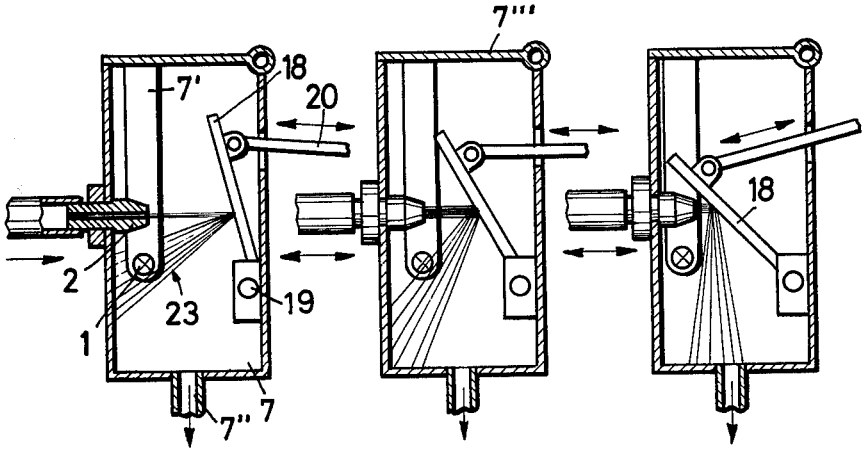
FIGS. 6, 7 and 8 each represent a cross-section through the injection chambers formed with such baffle plates, showing the plates in different positions.

The device shown in FIG. 1 for varied dyeing in batches of yarn or other filamentary material comprises in the main a plurality of dye injection nozzles 2 arranged one after the other in the direction of travel of the yarn to be dyed. The nozzles 2 are fed by respective supply pipes 4 extending from respective dye liquid supply containers 3. In the supply pipes 4 there are installed two separate valves 5, 5′ connected in series one after the other and operated electromagnetically, forming a so-called double valve. These separate valves 5, 5′ can be operated by electromagnetic impulse sources (not shown) for example punched cards, magnetic tapes and the like in such a way that they are opened or closed in relation to one another with phase shift. As shown for example in the diagram in FIG. 4, the pulse sequence can be so selected that one valve 5 begins to open at time $t_1$ and is open at time $t_2$ after an opening period $t_1$–$t_2$ lasting about 6 to 8 milliseconds. The valve 5 starts to close again at time $t_3$ after an open period $t_2$–$t_3$ of about 10 to 15 milliseconds and is closed again at time $t_4$ after a closing period $t_3$–$t_4$ of about 1 to 3 milliseconds. The other valve 5′ with the supposedly same opening and closing periods is on the other hand operated through the cycle with phase shift, that is, starting only at the time $t_5$. In this way in spite of the relatively long opening periods O of the individual valves, a very much shorter opening time O′ of the double valve is obtained due to technical factors, whereby extremely brief, reproducible dye injection times amounting to only a few milliseconds are achieved.

The double valves 5, 5′ with the dye injection nozzles 2 are for preference arranged on a slide 6 which can be moved to and from in the direction of travel of the yarn and which moreover carries an injection chamber 7 associated with each dye injection nozzle and provided with a yarn passage slit 7′. The injection chambers 7 can be connected for example as shown in FIGS. 6 to 8 through dye liquid return pipes 7″ with the relevant dye liquid supply tanks 3. It is also possible, however, with sparingly proportioned dye injection supply, to connect the injection chambers 7 to an exhaust duct 9 provided with a suction source or exhaust fam 8 as shown in FIG. 1.

To make sure that fresh dye liquid is always available under definite preliminary pressure upstream of the double valves 5, 5′ in the pipes 4, the upstream end portions 4′ of the supply pipes are each connected to dye liquid circulating pipes 10 which are connected to the bottoms of the appropriate dye liquid supply containers 3 and each of which contains a circulating pump 11 and a pressure reducing valve 12.

Beyond the dye injection nozzles 2 there is provided a blower nozzle 13 which acts as a contact-less twist producer and is equipped with nozzle ducts 14 for the blowing medium for example compressed air, the ducts being aligned transversely to the direction of travel of the yarn and tangentially thereto. The blower nozzle 13 is accommodated in a blower chamber 15 provided with apertures 15′ for the passage of the yarn and with a waste pipe in the floor for surplus dye liquid. The waste pipe can for example be connected to the exhaust duct 9.

The yarn 1 is taken from a winding coil (not shown) and is first looped round a guide roller 16 which serves to limit the twist. After this, the yarn 1, at a high rewinding speed amounting to 600 m per minute or more, runs through the injection chambers 7 past the dye injection nozzles then through the blower nozzle 13 which produces a twist in the yarn, and finally to a winding spool 17. As it passes the injection nozzles 2, the yarn is acted on with brief, reproducible, dye injection pulses amounting to only a few milliseconds which, as already mentioned above, can be controlled in the desired manner, that is in the corresponding time sequence and duration by way of the double valves 5, 5′. In this way, in spite of the high rate of travel of the yarn, extremely short portions of yarn can be differently dyed and by means of corresponding movement of the dye injection nozzles 2 or the slide 6 carrying them additional shifts of the portions being dyed can be affected. By means of the compressed air emerging from the blowing nozzle 13, the yarn 1 during its dye injection treatment is not only rotated, but at the same time freed from surplus adherent dye liquid, which is blown off from the yarn and removed by way of the waste pipe.

Moreover, owing to the production of the twist, there is correspondingly a wringing out of surplus dye.

Figure 5:
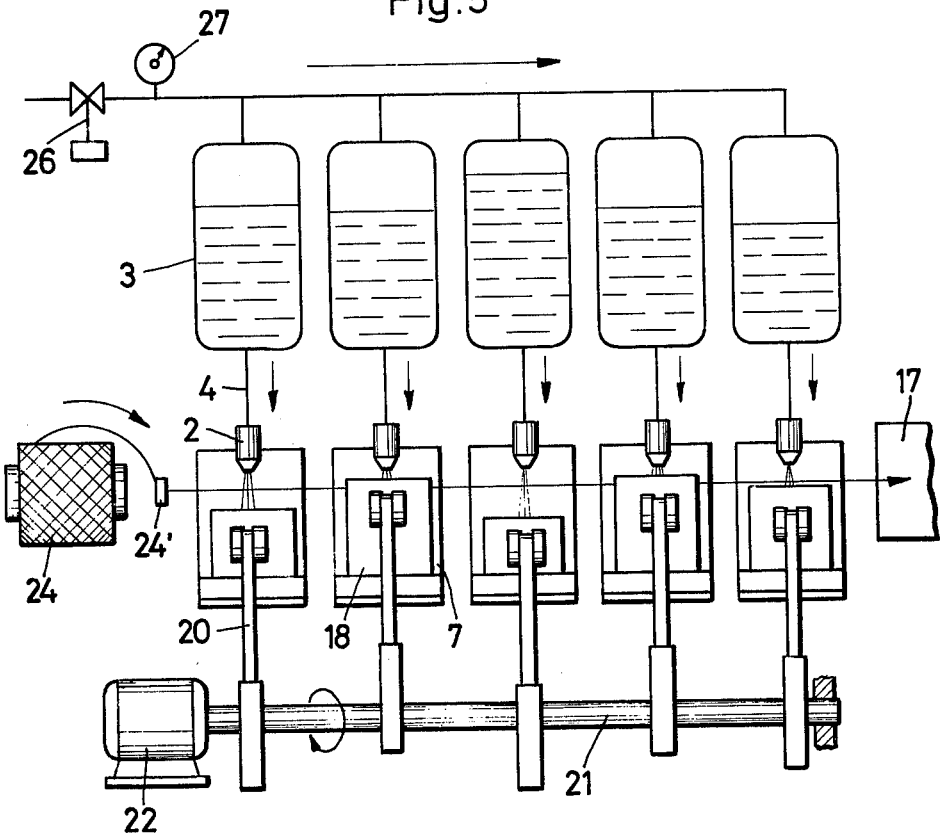
FIG. 5 is a plan view of a modified device of the invention with baffle plates reflecting jets of dyestuff emerging from the dye spraying nozzles.

In the case of the dye injection device shown in FIG. 5, the individual injection chambers 7 are provided with flap lids 7''' and with internal baffle plates 18 that can be movably driven to reflect the dye injection jets emerging from the nozzles 2 on to the yarn 1 as it travels past. For this purpose, the baffle plates 18 are mounted for pivotable movement about axes extending parallel to the direction of travel of the yarn, and they can be driven for example by associated movable levers 20 from a common cam shaft 21, which in its turn receives its drive from an electric motor 22. In this way, by additionally deflecting or reflecting the injection jets 23 it is possible to expose the yarn travelling past more or less intensively to the various dye spray cones, as will be clear from FIGS. 6 to 8. The twist that is to be applied to the yarn being treated is in this device obtained for preference simply by the yarn being drawn off in reverse from a winding spool 24, the yarn being accordingly passed through a guide eyeles 24' before it runs past the injection nozzles 2, after which it is wound on the spool 17.

The dye liquid supply pipes 4 leading to the injection nozzles are in this case connected directly to the dye liquid supply tank 3. To make sure that the dye liquid in the supply pipes 4 is always under an adjustable prepressure in this arrangement, the supply container 3 are connected through a supply pipe to a pressure source with a regulating valve 26 and a pressure indicator 27.

What we claim is:

1. Apparatus for dyeing filamentary textile material or the like in a varying manner along the length thereof, the combination comprising means for feeding such filamentary material along a predetermined path of travel; nozzle means for spraying a fluid dye; means for maintaining said filamentary material under tension and moving said filamentary material at high speed as it moves along said path of travel; said nozzle means being located adjacent said path of travel whereby spray emitted from said nozzle means may engage said filamentary material; a source of fluid dye; conduit means for conveying fluid dye from said dye source to said nozzle means; a plurality of valve means disposed in said conduit means in series relation; and means for opening and closing said valve means in adjustable phase relationship whereby short dye spray pulses are generated and emitted through said nozzle means; said valve means being actuated by the opening and closing means into open and close positions in an out-of-phase relationship such that said plurality of valve means are all open for a time interval enabling fluid dye to pass from said conduit means into said nozzle means for said time interval which is less than the time interval any valve means is in the open position.

2. In combination, a plurality of apparatuses of claim 1 arranged in series relation and disposed along the path of travel of said filamentary material.

3. The apparatus of claim 2 in which each dye spraying nozzle means is disposed in a spray chamber provided with openings for passage therethrough of said filamentary material; each of said chambers having a dye return line for removing dye falling from said filamentary material in said spray chamber and returning the same to the dye source for the said nozzle means.

4. The apparatus of claim 3 in combination with movable baffle plates disposed in said spray chambers adapted to deflect dye spray from the nozzle means onto the filamentary material passing through said spray chambers; said baffle plates being movable about axes substantially parallel to the path of travel of said filamentary material; a lever actuating each of said baffle plates and a common cam shaft adapted to simultaneously move said levers for said baffle plates.

5. The apparatus of claim 1 in combination with means imparting twist to the filamentary material located downstream of said nozzle means.

6. The apparatus of claim 1 in combination with a blast nozzle located downstream of the dye spraying nozzle means and having discharge openings for discharging a gaseous medium tangentially to the filamentary material for imparting a twist to the filamentary material after passing adjacent the dye-spraying nozzle means, and means limiting the twist imparted by said blast nozzle located upstream of said dye spraying nozzle means.

7. The apparatus of claim 6 in which said blast nozzle is disposed in a chamber having entrance and exit apertures for passage therethrough of said filamentary material; said chamber having an outlet for removal of dye removed from said filamentary material.

8. Apparatus of claim 1, characterized in that said dye spraying nozzle means, valves and spray chamber are mounted for reciprocal movement parallel to the filamentary material path of movement.

9. The apparatus of claim 1 in which said dye source has a recirculating pump adapted to recirculate dye in said source through a recirculating line, and a pressure reducing valve is disposed in said recirculating line; each dye conduit being connected to said recirculating line.

10. The apparatus of claim 1 in which said filamentary material is disposed on a reel from which it is removed in such manner as to generate a twist therein as it moves into said path of travel.

11. The apparatus of claim 1 in which said valve means are electrically energized and the valve coaction produces spray pulses having durations of a few milliseconds.

12. Apparatus for dyeing filamentary textile material or the like in a varying manner as it moves under tension at high speed along a path of travel from a supply reel to a take-up reel, the combination comprising nozzle means for spraying a fluid dye; said nozzle means being located adjacent the path of travel of such filamentary material whereby spray emitted from said nozzle means may engage said filamentary material; a source of fluid dye; conduit means for conveying fluid dye from said dye source to said nozzle means; two valve means disposed in said conduit means in series relation; and means for opening and closing said valve means in adjustable phase relationship whereby short dye spray pulses are generated and emitted through said nozzle means; said valve means being actuated by the opening and closing means into open and close positions in an out-of-phase relationship such that said valve means are open for a time interval enabling fluid dye to pass from said conduit means into said nozzle means for said time interval which is less than the time interval either valve means is in the open position.

* * * * *